US009522298B2

(12) United States Patent
Siemer

(10) Patent No.: US 9,522,298 B2
(45) Date of Patent: Dec. 20, 2016

(54) WEIGHT BAR ASSEMBLY

(71) Applicant: Kirk H. Siemer, Albert Lea, MN (US)

(72) Inventor: Kirk H. Siemer, Albert Lea, MN (US)

( * ) Notice: Subject to any disclaimer, the term of this patent is extended or adjusted under 35 U.S.C. 154(b) by 49 days.

(21) Appl. No.: 14/633,275

(22) Filed: Feb. 27, 2015

(65) Prior Publication Data

US 2016/0250512 A1 Sep. 1, 2016

(51) Int. Cl.

| | |
|---|---|
| ***A63B 71/00*** | (2006.01) |
| ***A63B 21/072*** | (2006.01) |
| ***A63B 21/075*** | (2006.01) |
| ***A63B 21/02*** | (2006.01) |
| ***A63B 21/00*** | (2006.01) |
| ***A63B 23/12*** | (2006.01) |
| *A63B 21/04* | (2006.01) |

(52) U.S. Cl.

CPC ..... *A63B 21/4035* (2015.10); *A63B 21/0004* (2013.01); *A63B 21/02* (2013.01); *A63B 21/4043* (2015.10); *A63B 21/4045* (2015.10); *A63B 23/12* (2013.01); *A63B 21/00043* (2013.01); *A63B 21/022* (2015.10); *A63B 21/023* (2013.01); *A63B 21/0407* (2013.01); *A63B 21/0428* (2013.01)

(58) Field of Classification Search

CPC ..... A63B 21/023; A63B 21/025; A63B 21/05; A63B 21/055; A63B 21/072; A63B 21/0724; A63B 21/4035; A63B 21/4043; A63B 21/4045; A63B 21/0004; A63B 21/00043; A63B 21/02; A63B 21/022;A63B 21/0407; A63B 21/0428; A63B 21/0442; A63B 21/4033

See application file for complete search history.

(56) References Cited

U.S. PATENT DOCUMENTS

| | | | | | |
|---|---|---|---|---|---|
| 818,242 | A * | 4/1906 | Geisel | A63B 21/0004 | 482/128 |
| 3,544,106 | A * | 12/1970 | Barrett | A63B 21/05 | 482/126 |
| 3,938,803 | A | 2/1976 | Wilmoth et al. | | |
| D262,730 | S | 1/1982 | Lambert, Jr. et al. | | |
| 4,618,142 | A * | 10/1986 | Joseph, Jr. | A63B 5/20 | 482/106 |
| 4,775,149 | A * | 10/1988 | Wilson | A63B 21/022 | 482/126 |
| 4,978,122 | A * | 12/1990 | Dibowski | A63B 21/0724 | 482/106 |
| 5,152,731 | A * | 10/1992 | Troutman | A63B 21/0724 | 482/106 |
| 5,474,511 | A | 12/1995 | Dantolan | | |
| 7,837,598 | B1 | 11/2010 | Boozel, Jr. | | |
| 9,254,408 | B1 * | 2/2016 | Otto | A63B 21/0724 | |

(Continued)

*Primary Examiner* — Joshua Lee

(57) ABSTRACT

A weight bar assembly includes a bar that has a first end and a second end and the bar is elongated between the first end and the second end. A pair of gripping units is provided and each of the gripping units is movably positioned around the bar. Thus, each of the gripping units is slidable between a center of the bar and an associated one of the first end and the second end. A collar is provided that has the bar extending therethrough and the collar is centrally positioned between the first end and the second end. Each of the gripping units abuts the collar. A first receiver is coupled to the first end and a second receiver is coupled to the second end.

7 Claims, 4 Drawing Sheets

(56) References Cited

U.S. PATENT DOCUMENTS

| | | | | |
|---|---|---|---|---|
| 9,375,601 | B2 * | 6/2016 | Miller | A63B 21/072 |
| 2012/0322630 | A1 * | 12/2012 | Hood | A63B 21/023<br>482/106 |
| 2014/0221173 | A1 * | 8/2014 | Crabtree | A63B 21/0724<br>482/106 |
| 2016/0023038 | A1 * | 1/2016 | Daflidis | A63B 21/1469<br>482/106 |
| 2016/0121159 | A1 * | 5/2016 | Rogers | A63B 21/4043<br>482/107 |

* cited by examiner

WEIGHT BAR ASSEMBLY

BACKGROUND OF THE DISCLOSURE

Field of the Disclosure

The disclosure relates to weight bar devices and more particularly pertains to a new weight bar device for providing laterally movable grips on a weight bar.

SUMMARY OF THE DISCLOSURE

An embodiment of the disclosure meets the needs presented above by generally comprising a bar that has a first end and a second end and the bar is elongated between the first end and the second end. A pair of gripping units is provided and each of the gripping units is movably positioned around the bar. Thus, each of the gripping units is slidable between a center of the bar and an associated one of the first end and the second end. A collar is provided that has the bar extending therethrough and the collar is centrally positioned between the first end and the second end. Each of the gripping units abuts the collar. A first receiver is coupled to the first end and a second receiver is coupled to the second end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
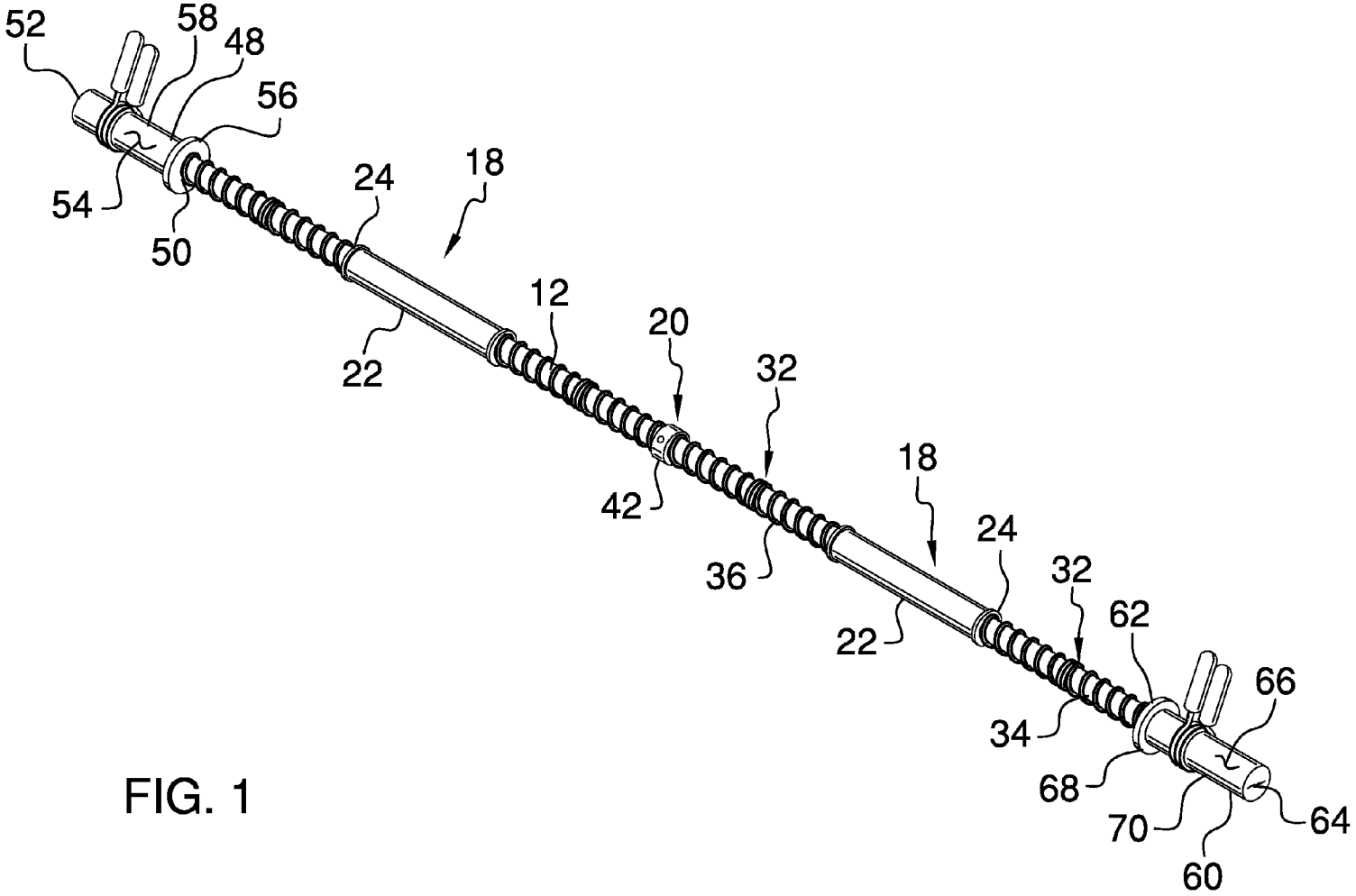
FIG. 1 is a top perspective view of a weight bar assembly according to an embodiment of the disclosure.
Figure 2:
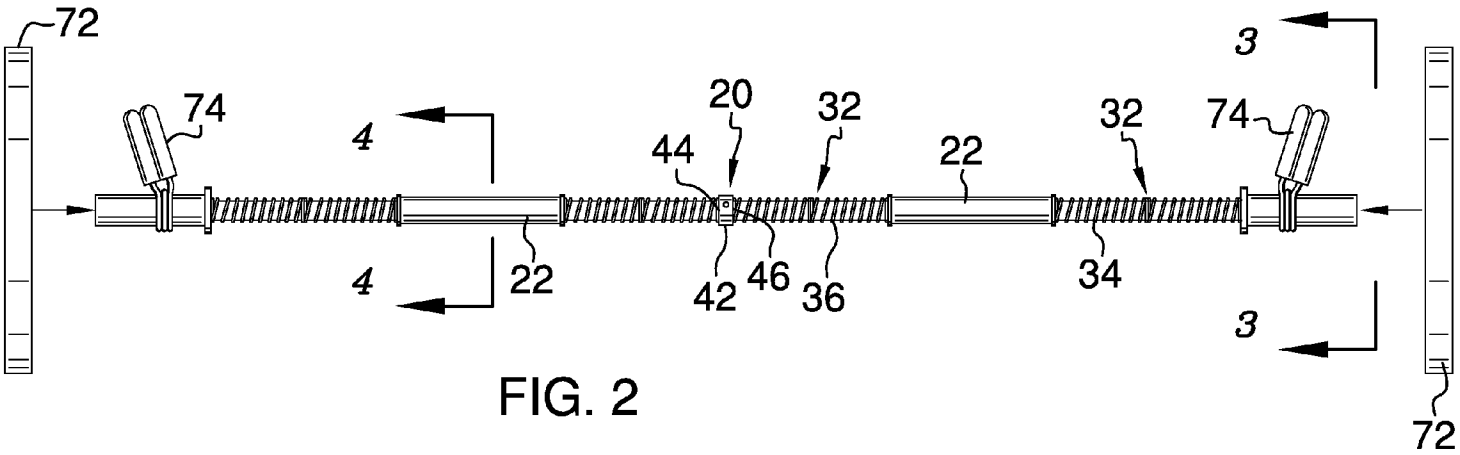
FIG. 2 is a front view of an embodiment of the disclosure.
Figure 3:
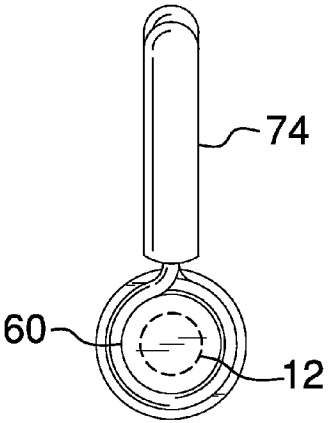
FIG. 3 is a right side view of an embodiment of the disclosure.
Figure 4:
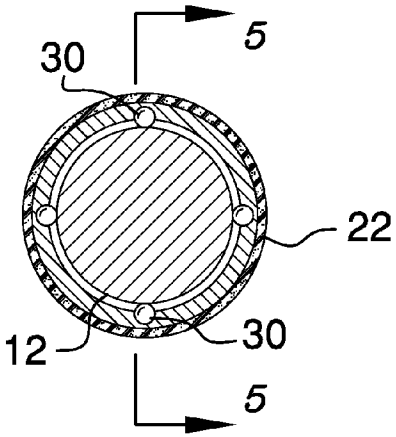
FIG. 4 is a cross sectional view taken along line 4-4 of FIG. 2 of an embodiment of the disclosure.
Figure 5:
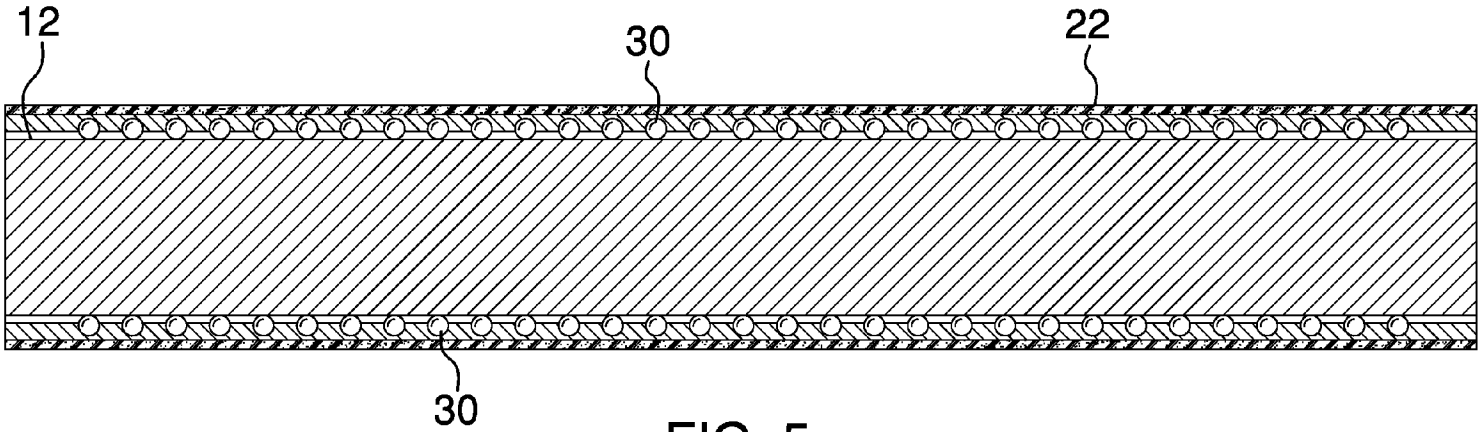
FIG. 5 is a cross sectional view taken along line 5-5 of FIG. 4 of an embodiment of the disclosure.
Figure 6:
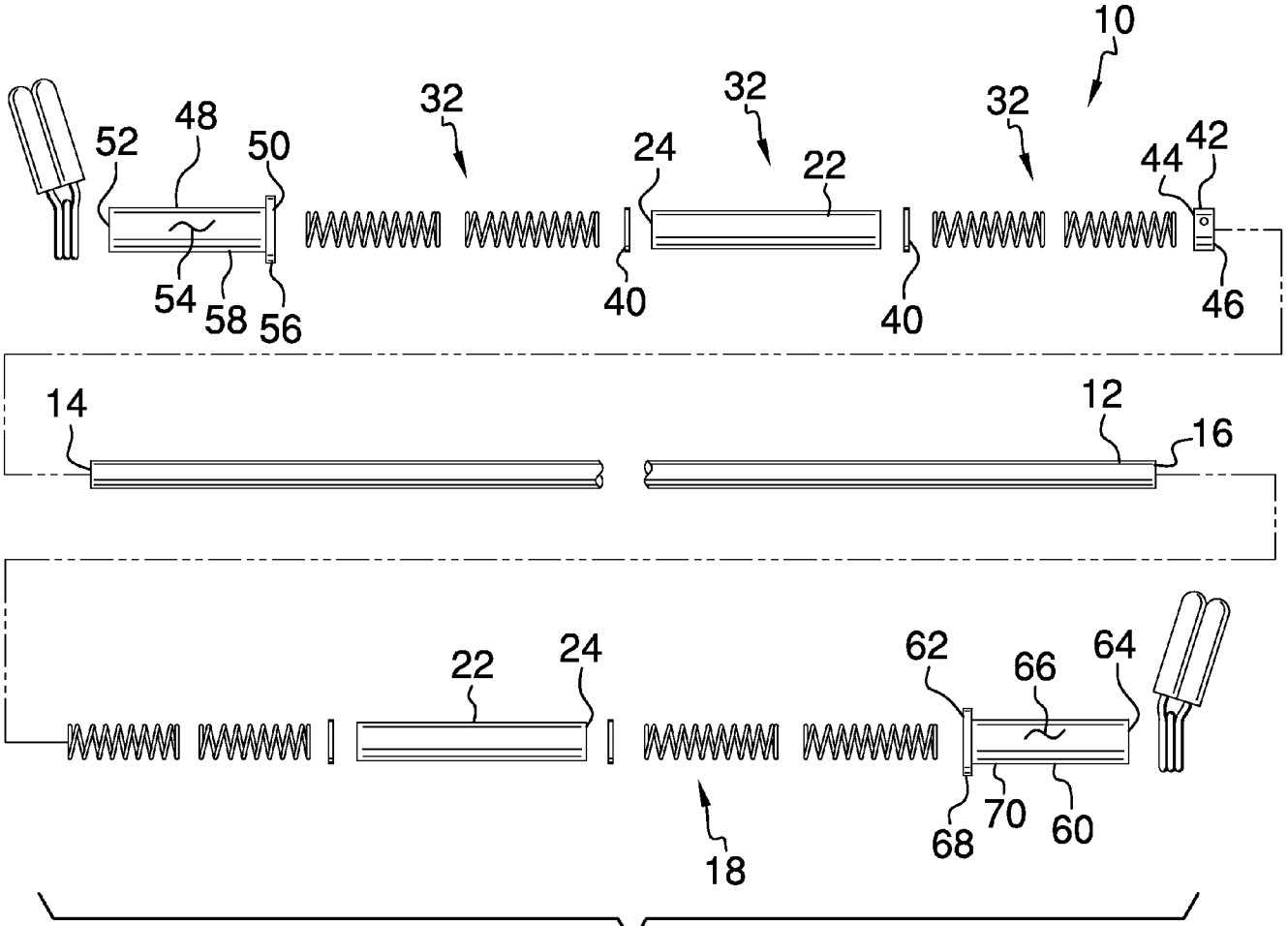
FIG. 6 is an exploded perspective view of an embodiment of the disclosure.

With reference now to the drawings, and in particular to FIGS. 1 through 6 thereof, a new weight bar device embodying the principles and concepts of an embodiment of the disclosure and generally designated by the reference numeral 10 will be described.

As best illustrated in FIGS. 1 through 6, the weight bar assembly 10 generally comprises a bar 12 that has a first end 14 and a second end 16 and the bar 12 is elongated between the first end 14 and the second end 16. The bar 12 may have a length ranging between approximately 70 inches and 80 inches and an outside diameter ranging between approximately 20 mm and 30 mm. A pair of gripping units 18 is provided and each of the gripping units 18 is movably positioned around the bar 12. Moreover, each of the gripping units 18 is slidable between a center 20 of the bar 12 and an associated one of the first end 14 and the second end 16 of the bar 12.

Each of the gripping units 18 comprises a sleeve 22 that has a primary end 24, a secondary end 26 and an outer wall 28 extending between the primary end 24 and the secondary end 26. Each of the primary end 24 and the secondary end 26 is open and the sleeve 22 is substantially hollow. The sleeve 22 has the bar 12 extending therethrough and the sleeve 22 may be gripped. A bearing 30 is positioned between the outer wall 28 and the bar 12 and the bearing 30 extends substantially between the primary end 24 and the secondary end 26. The bearing 30 engages the outer wall 28 and the bar 12 such that the bearing 30 reduces a friction between the sleeve 22 and the bar 12 thereby allowing the sleeve 22 to freely spin on the bar 12. The bearing 30 may be one of a plurality of bearings 30 each spaced apart from each other and distributed around an entire circumference of sleeve 22. The bearing 30 may comprise a ball bearing or the like.

A pair of biasing members 32 is provided and each of the biasing members 32 has the bar 12 extending therethrough. The pair of biasing members 32 includes an outermost biasing member 34 and an innermost biasing member 36 with respect to the center 20 of the bar 12. The outermost biasing member 34 extends away from the primary end 24 of the sleeve 22 and the innermost biasing member 36 extends away from the secondary end 26 of the sleeve 22. Each of the innermost 36 and outermost 34 biasing members biases the sleeve 22 to be centrally positioned between the center 20 of the bar 12 and the associated first end 14 and the second end 16 of the bar 12. Additionally, each of the innermost 36 and outermost 36 biasing members may be a spring biasing member. A pair of washers 40 is provided. One of the washers 40 is positioned between the primary end 24 and the outermost biasing member 34, and one of the washers 40 is positioned between said secondary end 26 and the innermost biasing member 36.

A collar 42 is provided that has a first bearing surface 44 and a second bearing surface 46 and the first bearing surface 44 and the second bearing surface 46 are each outward faces of the collar 42. The collar 42 has the bar 12 extending therethrough and the collar 42 is centrally positioned between the first end 14 and the second end 16 of the bar 12. The innermost biasing members 36 of each of the gripping units 18 abuts an associated one of the first bearing surface 44 and the second bearing surface 46 of the collar 42 such that the innermost biasing members 36 is compressible between an associated one of the sleeves 22 and the collar 42.

A first receiver 48 is provided that has a first end 50, a second end 52 and an outer surface 54 extending between the first end 50 and the second end 52. The outer surface 54 is arcuate such that the first receiver 48 has a cylindrical shape and the first receiver 48 has a first portion 56 and a second portion 58. The first portion 56 has a diameter that is greater than the second portion 58 and the first portion 56 is positioned adjacent to the first end 50 of the first receiver 48. A second receiver 60 is provided and the second receiver 60 has a first end 62, a second end 64 and an outer surface 66 extending between the first end 62 and the second end 64 of the second receiver 60. The outer surface 66 of the second receiver 60 is arcuate such that the second receiver 60 has a cylindrical shape. The second receiver 60 has a first portion 68 and a second portion 70 and the first portion 68 of the second receiver 60 has a diameter is greater than the second portion 70 of the second receiver 60. The first portion 68 of the second receiver 60 is positioned adjacent to the first end 62 of the second receiver 60.

The first end 50 of the first receiver 48 is coupled to the first end of the bar 12 and the first end 62 of the second receiver 60 is coupled to the second end 16 of the bar 12. The outermost biasing member 34 of each of the gripping units 18 abuts the first portion 56,68 of an associated one of the first receiver 48 and the second receiver 60. Thus, the outermost biasing member 34 of each of the gripping units 18 is compressible between an associated one of the sleeves 22 and the associated of the first receiver 48 and the second receiver 60. Each of the sleeves 22 is urgeable between the collar 42 and the associated one of the first receiver 48 and the second receiver 60 when the sleeves 22 are gripped and each of the first receiver 48 and the second receiver 60 may have weights 72 positioned thereon. Each of the first receiver 48 and the second receiver 60 may be an olympic weight adapter or the like. A pair of clamps 74 is provided and each of the clamps 74 is positionable on one of the first receiver 48 and the second receiver 60 to retain the weights on each of the first receiver 48 and the second receiver 60.

In use, the sleeves 22 are gripped and the bar 12 is utilized in the convention of weight lifting. Each of the sleeves 22 may be urged inwardly toward the collar 42 or outwardly toward the first receiver 48 and the second receiver 60 while the bar 12 is being utilized. The lateral motion of the sleeves 22 on the bar 12 allows variation in a range of motion while the bar 12 is being utilized in the convention of weight lifting. Additionally, the bar 12 may be utilized as a stand alone exercise implement.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weight bar assembly configured to allow a user's grip to move laterally along said assembly while said assembly is utilized, said assembly comprising:

a bar having a first end and a second end, said bar being elongated between said first end and said second end;

a pair of gripping units, each of said gripping units being movably positioned around said bar such that each of said gripping units is slidable between a center of said bar and an associated one of said first end and said second end, each of said gripping units comprising a sleeve having a primary end, a secondary end and an outer wall extending between said primary end and said secondary end, each of said primary end and said secondary end being open, said sleeve being substantially hollow, said sleeve having said bar extending therethrough, said sleeve being configured to be gripped;

a collar having said bar extending therethrough, said collar being centrally positioned between said first end and said second end, each of said gripping units abutting said collar;

a first receiver being coupled to said first end;

a second receiver being coupled to said second end;

eight biasing members, each of said biasing members having said bar extending therethrough, an outermost one of said biasing members extending away from said primary end of said sleeve and an innermost one of said biasing members extending away from said secondary end of said sleeve, each of said biasing members biasing said sleeve to be centrally positioned between said center of said bar and said associated first end and said second end.

2. The assembly according to claim 1, further comprising a bearing positioned between said outer wall and said bar, said bearing extending substantially between said primary end and said secondary end, said bearing engaging said outer wall and said bar such that said bearing reduces a friction between said sleeve and said bar thereby allowing said sleeve to freely spin on said bar.

3. The assembly according to claim 1, wherein said collar has a first bearing surface and a second bearing surface, said first bearing surface and said second bearing surface each being outward faces of said collar.

4. The assembly according to claim 1, wherein said first receiver has a first end, a second end and an outer surface extending between said first end of said first receiver and said second end of said first receiver, said outer surface being arcuate such that said first receiver has a cylindrical shape, said first receiver having a first portion and a second portion, said first portion having a diameter being greater than said second portion, said first portion being positioned adjacent to said first end of said first receiver.

5. The assembly according to claim 1, wherein said second receiver has a first end, a second end and an outer surface extending between said first end and said second end of said second receiver, said outer surface of said second receiver being arcuate such that said second receiver has a cylindrical shape, said second receiver having a first portion and a second portion, said first portion of said second receiver having a diameter being greater than said second portion of said second receiver, said first portion of said second receiver being positioned adjacent to said first end of said second receiver.

6. The assembly according to claim 1, wherein:

said first receiver has a first end and a first portion;

said second receiver has a first end and a first portion;

each of said gripping units including an outermost biasing member and a sleeve; and said first end of said first receiver being coupled to said first end of said bar, said first end of said second receiver being coupled to said second end of said bar, said outermost biasing members of said gripping units abutting said first portion of an associated one of said first receiver and said second receiver such that each of said outermost biasing members is compressible between said associated one of said sleeves and said associated first receiver and said second receiver, each of said sleeves being urgeable between said collar and said associated one of said first receiver and said second receiver when said sleeves are gripped, each of said first receiver and said second receiver being configured to have weights positioned thereon.

7. A weight bar assembly configured to allow a user's grip to move laterally along said assembly while said assembly is utilized, said assembly comprising:

a bar having a first end and a second end, said bar being elongated between said first end and said second end;

a pair of gripping units, each of said gripping units being movably positioned around said bar such that each of said gripping units is slidable between a center of said bar and an associated one of said first end and said second end, each of said gripping units comprising:

a sleeve having a primary end, a secondary end and an outer wall extending between said primary end and said secondary end, each of said primary end and said secondary end being open, said sleeve being substantially hollow, said sleeve having said bar extending therethrough, said sleeve being configured to be gripped;

a bearing positioned between said outer wall and said bar, said bearing extending substantially between said primary end and said secondary end, said bearing engaging said outer wall and said bar such that said bearing reduces a friction between said sleeve and said bar thereby allowing said sleeve to freely spin on said bar;

four biasing members, each of said biasing members having said bar extending therethrough, an outermost one of said biasing members extending away from said primary end of said sleeve, an innermost one of said biasing members extending away from said secondary end of said sleeve, each of said biasing members biasing said sleeve to be centrally positioned between said center of said bar and said associated first end and said second end;

a collar having a first bearing surface and a second bearing surface, said first bearing surface and said second bearing surface each being outward faces of said collar, said collar having said bar extending therethrough, said collar being centrally positioned between said first end and said second end, said innermost biasing members of said gripping units abutting an associated one of said first bearing surface and said second bearing surface of said collar such that said innermost biasing members are compressible between an associated one of said sleeves and said collar;

a first receiver, said first receiver having a first end, a second end and an outer surface extending between said first end of said first receiver and said second end of said first receiver, said outer surface being arcuate such that said first receiver has a cylindrical shape, said first receiver having a first portion and a second portion, said first portion having a diameter being greater than said second portion, said first portion being positioned adjacent to said first end of said first receiver; and a second receiver, said second receiver having a first end, a second end and an outer surface extending between said first end and said second end of said second receiver, said outer surface of said second receiver being arcuate such that said second receiver has a cylindrical shape, said second receiver having a first portion and a second portion, said first portion of said second receiver having a diameter being greater than said second portion of said second receiver, said first portion of said second receiver being positioned adjacent to said first end of said second receiver, said first end of said first receiver being coupled to said first end of said bar, said first end of said second receiver being coupled to said second end of said bar, said outermost biasing members of said gripping units abutting said first portion of an associated one of said first receiver and said second receiver such that each of said outermost biasing members are compressible between said associated one of said sleeves and said associated one of said first receiver and said second receiver, each of said sleeves being urgeable between said collar and said associated one of said first receiver and said second receiver when said sleeves are gripped, each of said first receiver and said second receiver being configured to have weights positioned thereon.

* * * * *